US005686708A

United States Patent [19]

Spencer

[11] Patent Number: 5,686,708

[45] Date of Patent: Nov. 11, 1997

[54] PROTECTIVE FUSE SHIELD FOR DISCONNECT SWITCHES

[75] Inventor: Charles Jeffrey Spencer, Chicago, Ill.

[73] Assignee: Appleton Electric Company, Chicago, Ill.

[21] Appl. No.: 673,295

[22] Filed: Jun. 28, 1996

[51] Int. Cl.[6] ..... H01H 9/20

[52] U.S. Cl. ..... 200/50.12; 200/50.02

[58] Field of Search ..... 200/50.02, 50.11, 200/50.12, 50.18, 50.19, 50.28, 50.3

[56] References Cited

U.S. PATENT DOCUMENTS

| | | | |
|---|---|---|---|
| 3,896,353 | 7/1975 | Burton et al. | 200/50.26 |
| 4,149,216 | 4/1979 | Kussy et al. | 361/642 |
| 4,233,482 | 11/1980 | DiMarco et al. | 200/255 |
| 5,212,624 | 5/1993 | Johnson et al. | 361/643 |
| 5,559,662 | 9/1996 | Happ et al. | 361/104 |
| 5,590,019 | 12/1996 | Fox et al. | 361/643 |

*Primary Examiner*—Matthew V. Nguyen
*Attorney, Agent, or Firm*—Jones, Day, Reavis & Pogue

[57] ABSTRACT

A fuse shield plate is pivotally mounted over the fuses which are electrically associated with a disconnect switch. The switch operating lever is connected to an interlock rod which extends to a dead front receptacle. Interfitting elements on the fuse shield and the interlock rod prevent the fuse shield from being opened when the operating lever has been moved to close the switch contacts. When the fuse shield is opened to expose the fuses, the interfitting elements prevent the operating lever from being moved to close the switch contacts.

4 Claims, 4 Drawing Sheets

PROTECTIVE FUSE SHIELD FOR DISCONNECT SWITCHES

The present invention relates to enclosed disconnect switches. More particularly, the present invention relates a protective fuse shield for the fuses used with such a device.

BACKGROUND OF THE INVENTION

Enclosed disconnect switches of the type under consideration are used to provide a power disconnect for fixed or portable electrical equipment, such as welders, generators and compressors where the switches will be subject to frequent operation. Typically, the disconnect switches are equipped to handle voltages as high as 600 VAC with an amperage range of 30 to 100 amps. Those disconnect switches are preferably provided with appropriate fuses.

The devices here under consideration are normally provided with a manually operated lever for turning the disconnect witch "on" and "off". In the case of an interlocked switch receptacle, the operating lever is typically connected to an interlock mechanism which in turn is connected to what is referred to in the trade as a dead front receptacle. The operating lever cannot be moved from the "off" to the "on" position until an electrical plug is properly and completely inserted into the dead front receptacle. When the electrical plug is fully inserted into the dead front receptacle, the operating lever may then be moved to the "on" position. The electrical plug cannot be withdrawn unless the switch is open. A representative prior art device is shown in U.S. Pat. No. 5,212,624, assigned to the assignee of the present application.

The present invention may also be used with a disconnect switch which is not associated with a dead front receptacle. In this case in lieu of the dead front receptacle the housing enclosing the switch is provided with an opening and bushing for receiving the electrical cables. In such a device, the interlock mechanism is not used to prevent movement of the operating lever as discussed above in connection with disconnect switches which are associated with dead front receptacles.

In ordinary locations where these disconnect switches are used, the fuses may be installed or removed while the power is on, and there will be no adverse effect if a spark is produced. However, in a hazardous location, a spark may ignite the atmosphere around the fuses causing an explosion. (Class I, Division 2 Hazardous Locations are defined in Article 500 of the National Electrical Code.) Thus, it is desirable to prevent access to the fuses when the operating lever has been turned to the "on" position, thereby adapting the disconnect switch to be explosion-proof and used in hazardous locations.

SUMMARY AND OBJECTS OF THE INVENTION

The present invention provides a protective fuse shield for a fuse assembly associated with a disconnect switch.

A primary object of the present invention is the provision of a protective fuse shield for a disconnect switch thereby contributing to safety irrespective of the environment in which the switch is used and also permitting such a switch to be used in hazardous locations.

Another object of the present invention is the provision of a disconnect switch associated with an interlock mechanism such that the fuse shield cannot be opened if the switch is closed and such that the switch cannot be closed if the shield is open.

These and other objects and advantages of the present invention will become apparent from the following specification disclosing a preferred embodiment.

DESCRIPTION OF A PREFERRED EMBODIMENT

Figure 1:
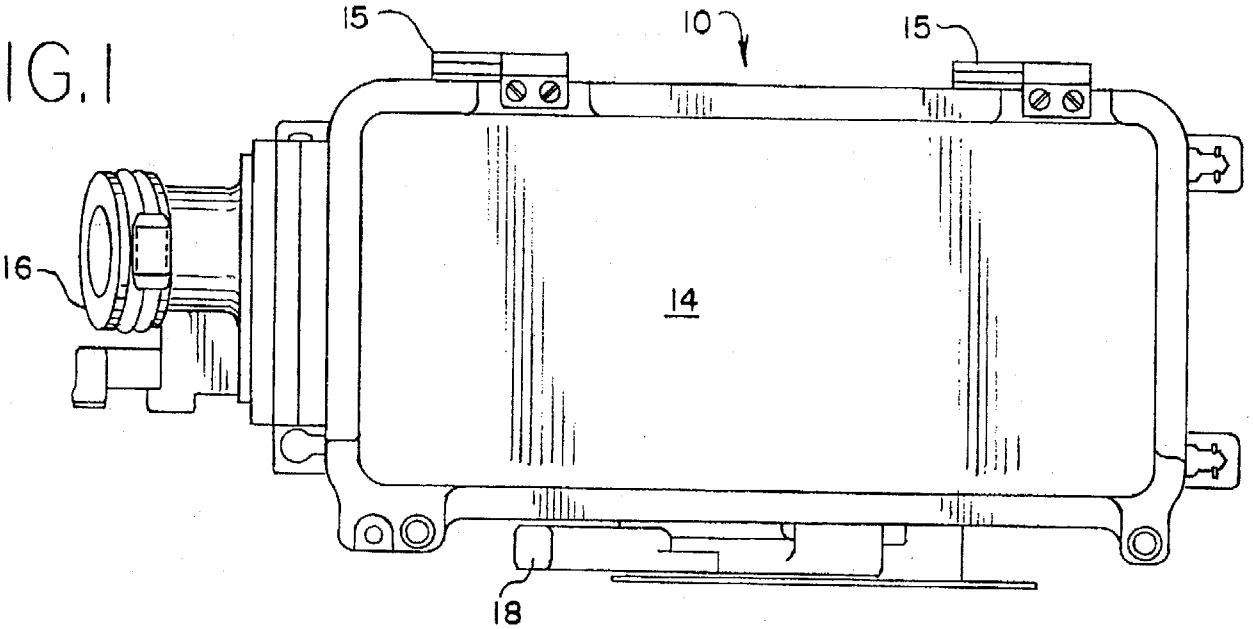
FIG. 1 is a top plan view of a single throw safety switch associate with a dead front receptacle.
Figure 2:
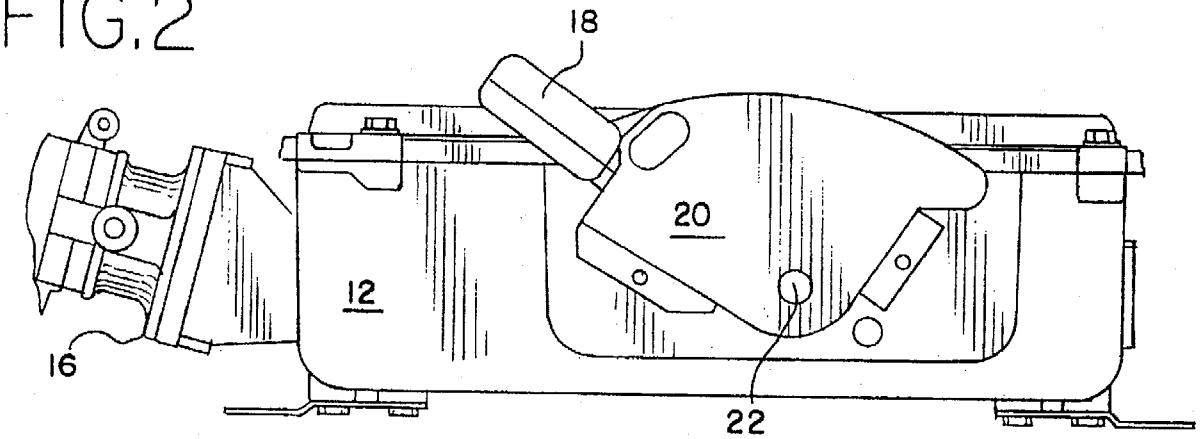
FIG. 2 is a side elevational view of the safety switch.

Referring to FIGS. 1 and 2, a heavy duty, single throw, safety switch with an interlocked switch receptacle is generally designated 10. Devices of this type are manufactured by the assignee of the present invention, Appleton Electric Company, under the WSR Series designation.

The device 10 has a main housing 12 with a cover 14 mounted thereon, as by means of a pair of hinges 15. It will be understood that the cover 14 may be swung from a closed position shown in FIGS. 1 and 2 to an open position permitting access to the housing 12. A seal is preferably provided between the housing and the cover thereby making the device dust-tight for use in hazardous locations.

Figure 4:
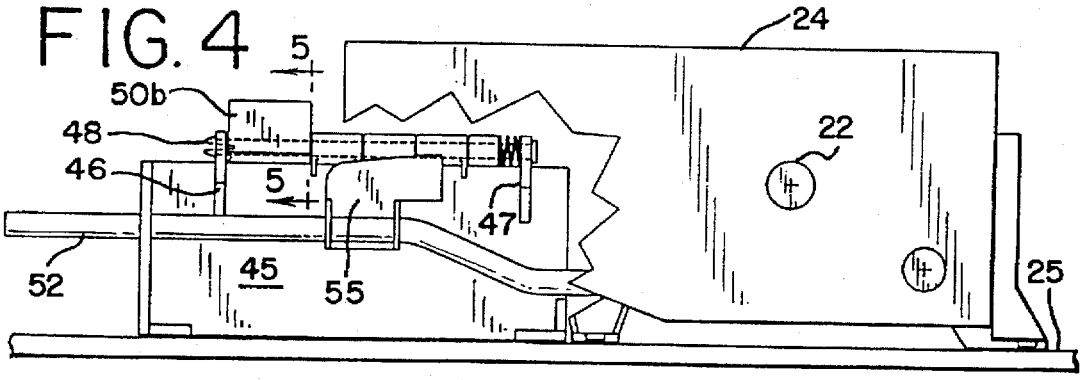
FIG. 4 is a side elevational view taken along the line 4—4 of FIG. 3.
Figure 7:
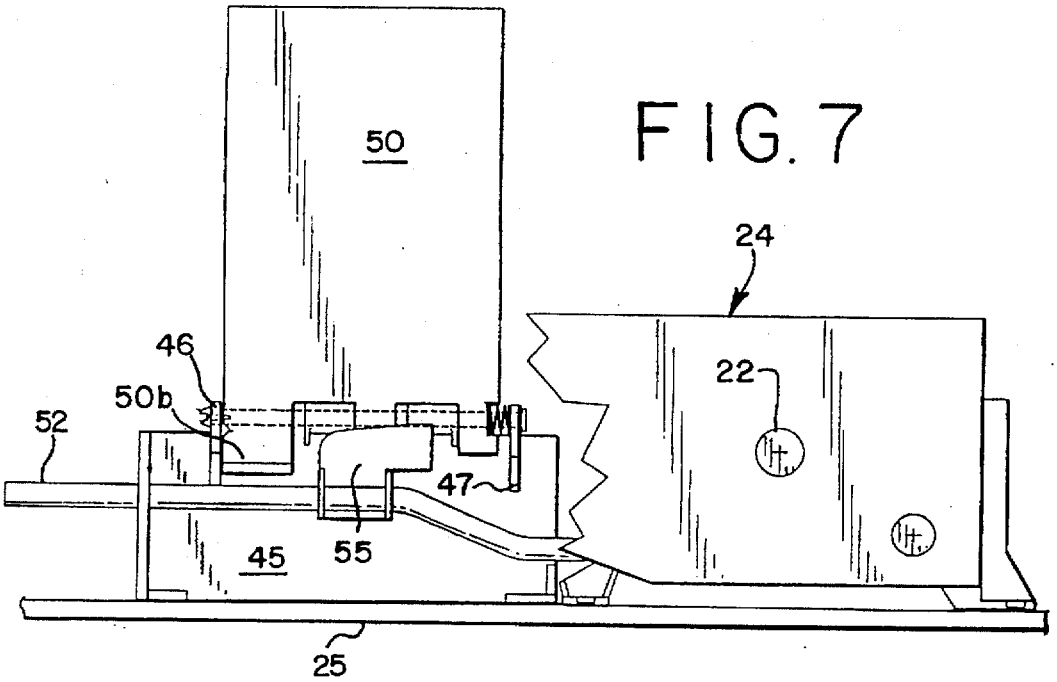
FIG. 7 is a side elevational view taken along the line 7—7 of FIG. 6.
Figure 8:
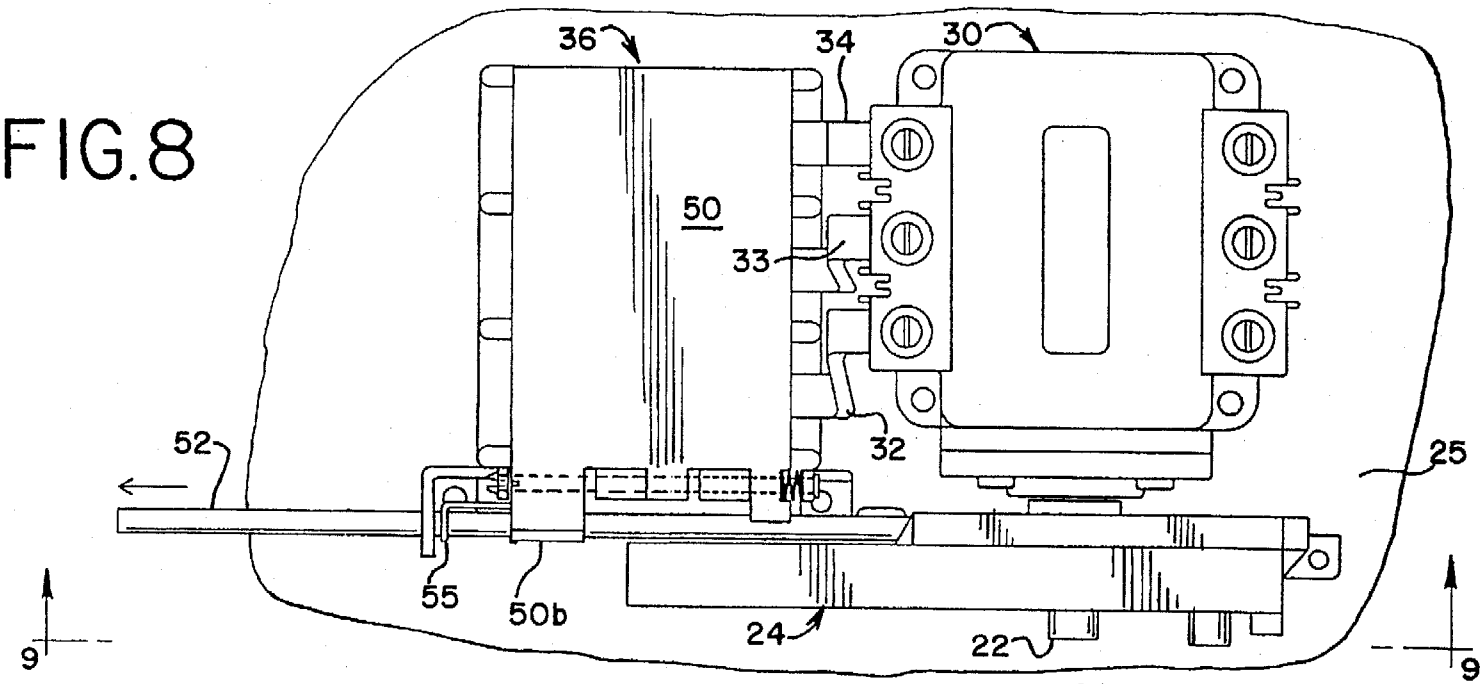
FIG. 8 is a top plan view of the disconnect switch and the fuse assembly when the switch is "on" and the fuse shield is closed.

The housing 12 includes a dead front receptacle 16. Housing 12 also mounts a manually operated operating lever 18 to turn the switch "on" and "off". The operating lever 18 is mounted behind a protective cover 20 and is connected to a shaft 22 forming part of an actuating mechanism, generally designated 24 as seen in FIGS. 4, 7 and 8. The actuating mechanism 24 is mounted to the bottom wall 25 of the housing 12.

The operating lever 18 is shown in its "off" or open position in FIGS. 1 and 2. It will be understood that the operating lever is swung in a clockwise direction for imparting corresponding clockwise rotation to the shaft 22 for closing the switch, i.e., turning the switch to the "on" position. Of course, the switch is opened by rotating the lever 18 in a counterclockwise position from the "on" position to the "off" position best shown in FIG. 2. The various parts herein described above are well known to those skilled in the art and thus need no detailed description herein.

A disconnect switch assembly, generally designated 30, is mounted within the housing 12 and is suitably supported by the housing bottom wall 25. This disconnect switch is preferably of the type disclosed in application, attorney no. 080653-026-047, Ser. No. 08/672,675, filed Jun. 28, 1996 and assigned to the assignee of the present application. However, other types of disconnect switches, well known to those skilled in the art, may be employed.

Figure 6:
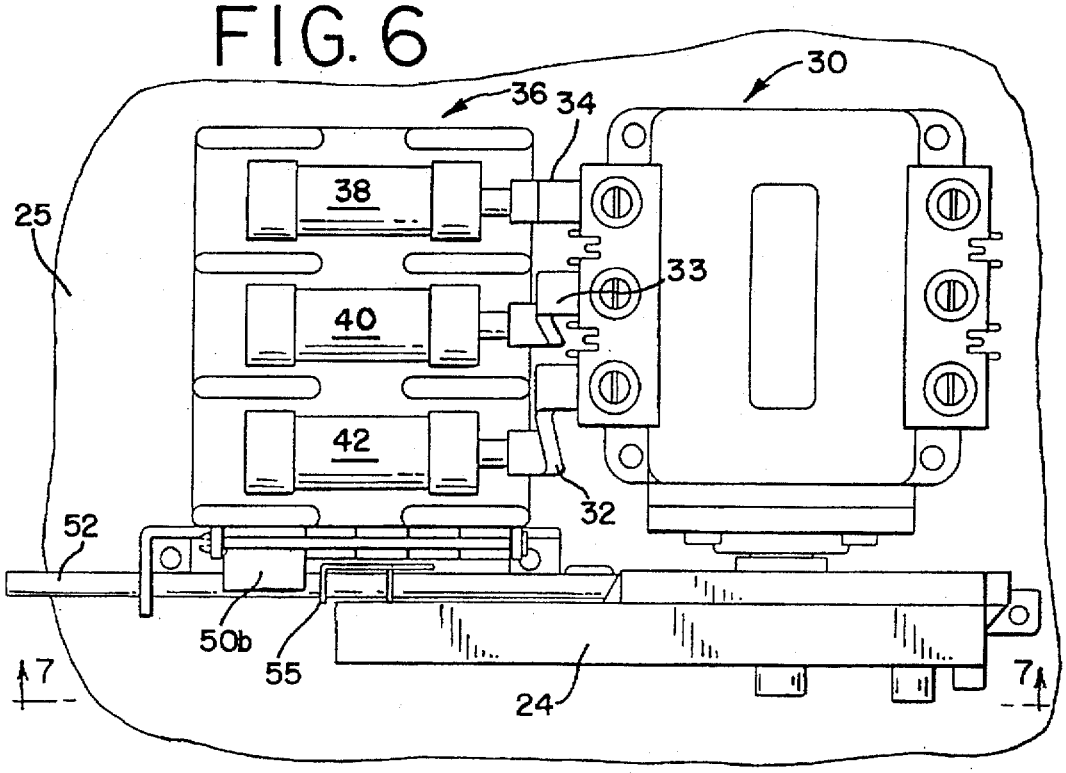
FIG. 6 is a top plan view of the disconnect switch and fuse assembly when the switch is "off" and the fuse shield is open.

The disconnect switch 30 is electrically connected, as by contact bars 32, 33 and 34, to a fuse assembly, generally designated 36. Fuse assembly 36 is adapted to removably mount three fuses 38, 40 and 42 (FIG. 6). It is understood that the fuses are removably mounted in the assembly 36 by means well known to those skilled in the art.

The bottom wall 25 of the housing 12 mounts a vertically disposed wall 45. This wall includes integral ears 46, 47 which are apertured for receiving a hinge pin 48. A generally planar fuse shield cover, which is preferably made of a transparent plastic material, includes integral annular formations 50*a* which receive the hinge pin 48. Thus, the shield 50 is mounted for swinging movement about the axis of the hinge pin 48. The shield 50 is swingable back and forth between a closed position (FIGS. 3, 4, 8 and 9) and an open position (FIGS. 6 and 7). When the shield 50 is in its closed position, it rests over the fuses 38, 40 and 42 thereby preventing access to the fuses. When the shield 50 is in its vertical or open position, access to each of the fuses is permitted.

The fuse shield 50 includes an integral tab 50*b* bent at a right angle to the body of the shield. As will be understood from the discussion to follow, the tab 50*b* constitutes an abutment formation defining part of an interlock system.

Actuating mechanism 24 includes an interlock rod 52. It will be understood that the interlock rod 52 extends to the dead front receptacle 16 and forms part of the interlock system for preventing swinging of the operating lever 18 to the "on" position unless the plug is fully and completely seated within the dead front receptacle 16. Further, this interlock system will prevent removal of the plug unless the switch is in the "off" or open position.

As mentioned above, the present invention may be used with a disconnect switch which is not associated with a dead front receptacle. In that case, the housing 12 (FIGS. 1 and 2) will simply include an opening and bushing in place of the receptacle 16. However, the interlock rod will still be provided as part of the actuating mechanism 24.

Figure 9:
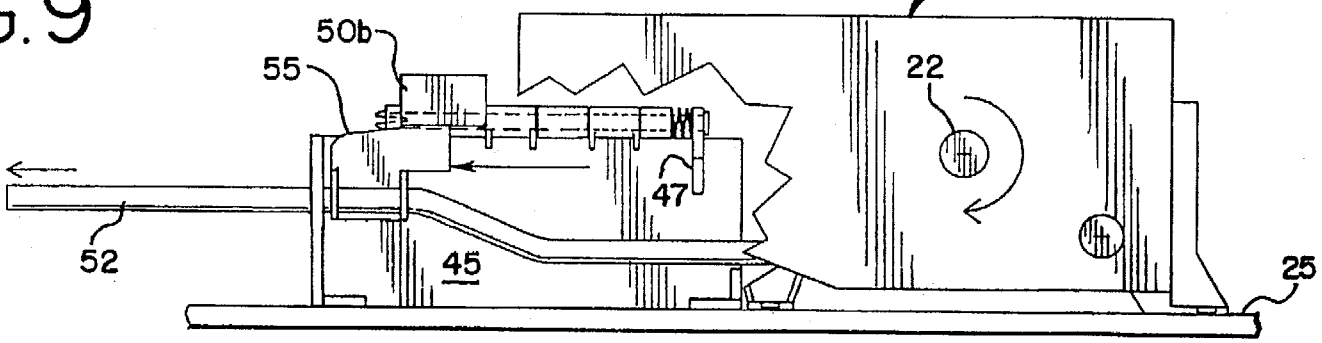
FIG. 9 is an elevational view taken along the line 9—9 of FIG. 8.

When operating lever 18 is swung clockwise to its "on" position, the rod 52 will be moved from right to left as seen in FIGS. 4, 7 and 9. When the operating lever 18 is moved counterclockwise to open the switch, the rod 52 will be moved from left to right as seen in FIGS. 4, 7 and 9.

A lug 55 is mounted to the rod 52 for movement therewith. As we will now explain, the lug 55 cooperates with the tab 50*b* to form a safety interlock mechanism which is part of the invention.

Figure 3:
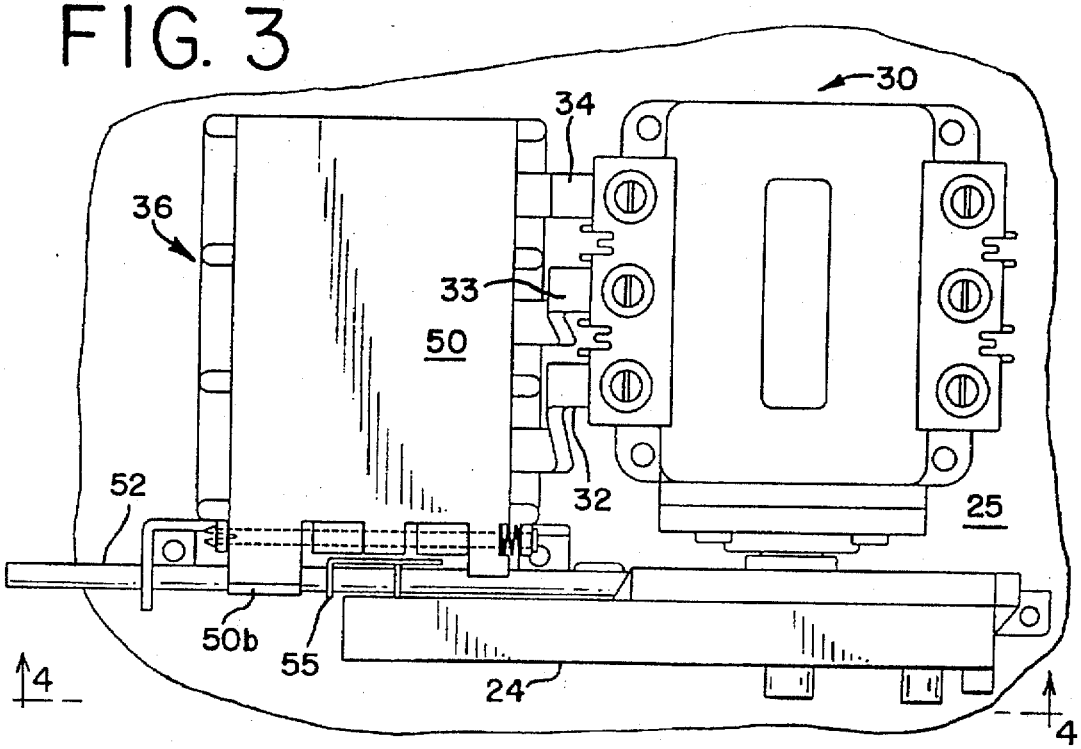
FIG. 3 is an enlarged top plan view with the enclosure removed and showing the disconnect switch and the fuse assembly when the switch is "off" and the fuse shield is closed.
Figure 5:
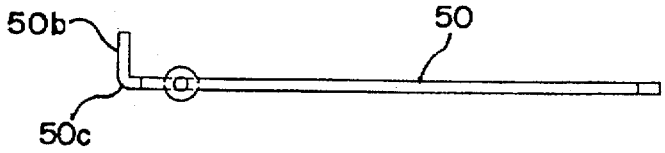
FIG. 5 is a section taken along the line 5—5 of FIG. 4.

Referring to FIGS. 3 and 4, the cover plate is shown in the closed position and with the switch "off". FIGS. 8 and 9 shown the shield 50 in the closed position and the switch in the "on" or closed position. It is noted that the lug 55 has been moved from right to left in response to movement of the actuating lever in a clockwise direction from its "off" position (FIG. 2) to its "on" or closed position. Referring to FIGS. 8 and 9, it will be seen that the shield 50 now may not be opened as the lug 55 will be disposed under portion 50*c* of the shield as shown in FIG. 5. Consequently, when the switch is in its "on" or closed position, access to the fuses is not possible.

Referring to FIGS. 6 and 7, the fuse cover is shown in its open position and the switch is shown in its "off" or open position. It will be seen that the lug 55 is spaced from the tab 50*b* thereby permitting swinging movement of the shield 50 to its open position. Referring particularly to FIG. 7, it is seen that when the shield 50 is in its open position, it will not be possible to close the switch. Any attempt to do so will result in movement of the lug 55 from right to left where the lug 55 will engage the tab 50*b* on the shield. Thus, when the shield is open, it is not possible to close the switch and energize the contacts associated with the fuses.

Thus, the present invention provides an important safety feature in a disconnect switch of the type described. When the switch is closed, it is not possible to open the protective shield. If the protective shield is in the open position, it is not possible to close the switch. Consequently, fuses may be changed only when the switch is off.

While a preferred embodiment has been shown and described in accordance with the present invention, it is to be understood that the invention is not to be limited to the embodiment shown but is susceptible to numerous changes and modifications as known to persons skilled in the art. Therefore, the invention is not to be limited to the details shown and described herein but includes all changes and modifications which are within the scope of the following claims.

What is claimed is:

1. In a disconnect switch assembly having a housing, the improvement comprising:

(a) a disconnect switch mounted within said housing;

(b) an operating lever connected to said disconnect switch and mounted by said housing for swinging movement back and forth between "on" and "off" positions;

(c) a fuse assembly including at least one removable fuse mounted within said housing in electrical contact with said disconnect switch;

(d) an interlock rod connected to said lever, said interlock rod being mounted in said housing for movement in a first direction when said lever is moved from its "off" to its "on" position and in a second opposite direction when said lever is moved from its "on" position to its "off" position;

(e) a fuse shield cover and means in said housing mounting said shield for movement back and forth between open and closed positions, said shield preventing access to said fuses when in its closed position and permitting access to said fuses when in its open position; and (f) first and second abutment formations on said actuating rod and said cover, respectively, said abutment formations being in a first interfering relationship when said shield is open thereby preventing movement of said interlock rod in its first direction, said abutment formations being in a second interfering relationship when said shield is closed thereby preventing opening of said shield after said operating lever has been moved to its on position, said abutment formations permitting movement of said actuating rod in both its first and second directions when said shield is closed.

2. The improvement according to claim 1 wherein said first abutment formation includes a bracket mounted on said interlock rod and wherein said second abutment formation includes a tab extending from said shield at a generally right angle, said tab being in the path of travel of said bracket when said cover is in its open position.

3. The improvement according to claim 2 wherein said shield is generally planar and wherein said tab is integral with said cover.

4. The improvement according to claim 1 wherein said means mounting said shield includes hinge means defining a hinge axis which is parallel to the path of movement of said interlock rod.

* * * * *